United States Patent [19]

Morssinkhof

[11] Patent Number: 4,496,434

[45] Date of Patent: Jan. 29, 1985

[54] PROCESS OF ELECTROFORMING A METAL PRODUCT AND AN ELECTROFORMED METAL PRODUCT

[75] Inventor: Gerhardus H. Morssinkhof, Boxmeer, Netherlands

[73] Assignee: Stork Screens B.V., Netherlands

[21] Appl. No.: 551,303

[22] Filed: Nov. 14, 1983

[30] Foreign Application Priority Data

Nov. 12, 1982 [NL] Netherlands ..... 8204381

[51] Int. Cl.[3] ..... C25D 1/08; C25D 7/00

[52] U.S. Cl. ..... 204/11; 204/24

[58] Field of Search ..... 204/11, 24, 40

[56] References Cited

U.S. PATENT DOCUMENTS

| | | | |
|---|---|---|---|
| 4,039,397 | 8/1977 | Klemm | 204/11 |
| 4,383,896 | 5/1983 | Pruyn | 204/11 |
| 4,397,715 | 8/1983 | Mohan | 204/11 |
| 4,436,591 | 3/1984 | de Hek | 204/11 |

*Primary Examiner*—Thomas Tufariello

*Attorney, Agent, or Firm*—Ostrolenk, Faber, Gerb & Soffen

[57] ABSTRACT

The invention relates to a process of electroforming a metal screen by electrolytically depositing a metal upon a metal matrix, having recesses filled with insulating material, a separating means, such as beeswax, being provided upon the ribs bounding the recesses.

The formed first screen skeleton is removed and subjected to an electrolysis in a second electrolytic bath for depositing the same or another metal upon the first screen skeleton.

Finally from a third electrolytic bath a top layer of metal is deposited upon the layer deposited from the second electrolytic bath.

In a preferred process the first electrolytic bath is a nickel bath, the second electrolytic bath is an iron bath or a bath of a nickel-iron alloy and the third electrolytic bath a nickel or nickel-tin alloy bath.

The second and other or third electrolytic bath contain an organic compound improving deposit of metal or metal alloy substantially perpendicular to the surface of the skeleton.

The invention also comprises a metal screen comprising a first product skeleton, an intermediate metal layer deposited thereon from a second electrolytic bath and a top layer deposited upon the intermediate layer from a third electrolytic bath the inner edges bounding the apertures being substantially free from metal of the intermediate layer and of the top layer.

12 Claims, No Drawings

PROCESS OF ELECTROFORMING A METAL PRODUCT AND AN ELECTROFORMED METAL PRODUCT

BACKGROUND OF THE INVENTION

1. Field of the Invention

The present invention relates to a process of electroforming a metal product, more particularly a screen, by subjecting a first thin product skeleton formed upon a matrix in a first electrolytic bath and subsequently stripped from the matrix, to an electrolysis in a second electrolytic bath, comprising at least one organic compound improving the growth of metal in a direction substantially perpendicular to the plane of the skeleton.

2. Description of the Prior Art

A process of this type for electrolytically forming a screen has been used in the art and is disclosed in NL. S No. 80,021,97. In this known process a first thin screen skeleton is formed by electrodepositing nickel metal upon the ribs of a steel plate comprising recesses filled with a di-electric material, e.g. bituminous material. Prior to stripping the formed first screen skeleton from the matrix and to facilitate said stripping, the separating ribs are provided with a layer of beeswax as a separating means.

Thereupon said first thin screen skeleton is thickened in a second electrolytic bath at least comprising one organic compound to improve a metal growth, in a direction substantially perpendicular to the plane of the screen to obtain the desired screen.

The screen as formed suffers from a number of drawbacks, getting the more serious in case of more or less differing properties between the deposited metal layer and the screen skeleton, but even when identical metals are being used, the following shortcomings will arise:

(a) The final screen has an a-symmetrical building up of materials, resulting in different properties inherent therewith, such as ductility and corrosion resistance. In addition thereto the optical appearance of said screens is imperfect;

(b) the mechanical resistance of the screen is extremely small if soft types of metals have been used for one of the two layers.

It should also be noted that it is known per se from NL. S No. 70,024,67 to electroform a screen by depositing a first metal upon a matrix in a first electrolytic bath and to subsequently deposit thereon a second metal in a second electrolytic bath, said metals differing from each other. Said Patent Application No. 70,024,67 describes the use of soft metals for this purpose, the thickness of the obtained screen consisting for 25% to 75% of hard metal.

Apart from the fact that no use is made in this known process of at least three electrolytic baths, in addition a thin product skeleton as deposited upon a matrix in a first electrolytic bath is not strippd from the matrix prior to subjecting the obtained first thin skeleton to an electrolysis in a second electrolytic bath. As a result products, and more particularly screens, in which an optimum metal growth occurs, in a direction substantially perpendicular to the skeleton, cannot possibly be obtained.

SUMMARY OF THE INVENTION

It is a main object of the present invention to provide a process of forming a metal product, more particularly a screen, which does not show the aforementioned disadvantages.

This object is achieved according to the invention in that the first skeleton thickened in the second electrolytic bath is subjected to an electrolysis in at least one other electrolytic bath, also comprising an organic compound improving growth of metal on the outer surface of the thickened skeleton in a direction substantially perpendicular to said outer surface.

In this manner a product, more particularly a screen, is obtained, which, when substantially employing at least three electrolytic baths, will possess optimum properties as regards corrosion resistance and ductility and will exhibit a flawless outer appearance; the mechanical resistance of the screen being very high.

Very advantageously in the other electrolytic bath a surface layer is deposited upon the skeleton as obtained from the second bath of a metal identical to that deposited on the first thin product skeleton, more particularly a screen skeleton. In this manner a screen can be obtained, having two surfaces of the same desired metal, the metal layer disposed thereinbetween and deposited in the second electrolytic bath, consisting of a metal entirely different from that of the metal of the thin product skeleton and the surface layer. The use of a particularly flexible metal for said intermediate layer, will result in screens having great mechanical stength properties and, in addition thereto, optimum properties with a view to the properties of the metal surface layer.

In the second electrolytic bath of the invention advantageously a metal is deposited upon the skeleton with a hardness greater than that of the metal as deposited in the first electrolytic bath or other electrolytic bath(s), respectively.

In depositing nickel from the second electrolytic bath a very hard and sturdy screen is obtained, presenting extremely good properties, as mechanical damages will not or only difficultly be able to cause any deformation.

It will be obvious that not only one metal need be deposited in the second and subsequent, other electrolytic bath(s) as also metal alloys may be used, causing products to be obtained with excellent properties.

For certain purposes it may be preferable to deposit a tin-nickel alloy in the other or third electrolytic bath, nickel being deposited in the first electrolytic bath and iron in the second bath. Nickel-iron can also be used for the second bath. In this manner a screen is obtained which is also particularly resistant to mechanical damages, due to the relatively easily deformable tin-nickel material which has been deposited in the other electrolytic bath(s).

It is particularly recommended to maintain a liquid flow through the apertures of the product skeleton during the electrolysis in the second and other electrolytic bath(s), more particularly a flow of electrolytic bath liquid from the cathode toward the anode.

In this manner a screen skeleton is obtained with excellent properties as concerns the shape of the screen apertures, since said apertures are substantially exactly identical to those of the first screen skeleton.

In the foregoing the expression "another electrolytic bath" has been used, but it will be obvious that use may also be made of several other electrolytic baths to obtain the desired thickness of the final screen and the optimum properties required for a certain type of screen. It is also obvious that this feature also holds for various other articles.

In a certain embodiment of the process according to the invention a first, a second and another electrolytic bath are used, in which one and the same metal, possessing different properties, if any, is deposited constantly. This embodiment also provides a screen having better properties than a screen obtained from a first product skeleton obtained by using a first and second electrolytic bath from which identical metals are deposited.

The present invention also comprises a metal product, more particularly a screen skeleton, comprising a first electrolytically formed product skeleton and a layer deposited electrolytically from a second electrolytic bath, in which the edges of the metal product, more particularly the edges of the apertures in a screen, are substantially free from metal deposited in the second electrolytic bath and free from metal deposited as a top layer from at least one other electrolytic bath or baths.

The organic compound improving or facilitating a growth of metal in a direction substantially perpendicular to the outer plane of the skeleton, is preferably an organic compound at least comprising a double or triple bond not belonging to a $=\overset{|}{C}-\overset{\|}{\underset{|}{S}}=O$ group and presenting properties of a second class brightener.

The features of the present invention which are believed to be novel are set forth with particularity in the appended claims.

Other claims and many of the attendant advantages will be more readily appreciated as the same becomes better understood by reference to the following detailed description.

SURVEY OF EXAMPLES

Example I

Upon a nickel base matrix which may have a flat or cylindrical shape and being provided with recesses bounded by ribs, a nickel layer is deposited, after the recesses have been filled with a di-electric material, for example bitumen and the ribs have been provided with a thin layer of beeswax. A thin first nickel screen skeleton is formed having a thickness of 20 microns.

The formed first nickel product or screen skeleton is subsequently stripped from the metal matrix and disposed in an electrolytic iron bath having the following composition:

$FeSO_4.7H_2O$: 250–500 gr/l $(NH_4)2(SO)_4$: 30–50 gr/l

Boric acid: 30–50 gr/l

Care is taken that the bath contains less than 0.02 gr/l of ferric ions.

The iron bath additionally comprises an organic compound facilitating the selective growth of metal in a direction perpendicular to the plane of the first screen skeleton. In the present case said compound consists of hydroxy-proprionitrile in a quantity of 0.1–100 mmol/l, although use can also be made of, e.g., ethylenecyanohydrin.

In the second electrolytic bath the electrolysis proceeds at a temperature of 70° C., a pH comprised between 3.8 and 4.2 and a current density in the range of 5.0 to 20.0 A/dm$^2$. Electrolysis is continued until an iron layer has been deposited with a thicness of about 160 microns.

The obtained screen skeleton comprising the deposited iron layer is subsequently disposed in another electrolytic Watt's bath and provided with a nickel top layer by electrolysis, until a layer of 20 microns thickness has been disposited.

In this manner a screen is obtained consisting of two nickel surfaces, both having a thickness of 20 microns and of an intermediate iron layer with a thickness of 160 microns.

Said screen possesses excellent properties.

Care is taken that during the electrolysis in the second and in the other or third electrolytic bath, a liquid flow occurs from the cathode towards the anode, thus maintaining a liquid flow through the apertures in the screen skeleton.

Very advantageously the flow through the apertures of the screen skeleton proceeds with a velocity in the range of 0.1 to 5.5 cm/sec.

Example II

A first thin nickel screen skeleton is produced in a manner as described in example I.

In a second electrolytic bath an iron layer is deposited upon the first screen skeleton, after the same has been stripped from the metal matrix; said iron layer having a thickness of 160 microns, whereas the initial screen skeleton possessed a thickness of 20 microns.

The iron bath also comprises an organic compound improving the growth of metal in a direction perpendicular to the plane of the screen skeleton, the organic compound being in this case ethylenecyanohydrin, although the use of hydroxyproprionitrile will also produce the same results.

In another or third electrolytic bath, generally known as an electrolytic Watt's bath, a tin-nickel layer is subsequently deposited upon the abovementioned iron layer.

In this manner a screen is obtained, particularly suitable for screen printing, in view of the optimum properties of the screen and the mechanical properties inherent with the applied intermediate iron layer.

Example III

A first nickel screen skeleton having a thickness of 20 microns, is formed in a manner corresponding to example I.

After having stripped the first skeleton from the matrix, said screen skeleton is disposed in an electrolytic nickel-iron bath.

The screen skeleton then provided with a nickel-iron layer with a thickness of 160 microns is finally disposed in a third electrolytic bath, containing a nickel alloy, for example, a thin-nickel alloy.

As a result a screen for screenprinting of excellent quality is obtained.

Although the present invention has been described in connection with some exemplified embodiments thereof, it will be apparent to those skilled in the art that many variations and modifications may be made without departing from the invention in its broader aspects. It is therefore intended to have the appended claims cover all such variations and modifications as fall within the true spirit and scope of the invention.

What is claimed is:

1. A process of electroforming a metal screen by subjecting a first product skeleton formed upon a matrix in a first electrolytic bath and subsequently stripped from the matrix, to an electrolysis in a second electrolytic bath, comprising at least a metal structure having a hardness and ductility different from that of said metal screen and an organic compound improving a growth of metal in a direction substantially perpendicular to the plane of the skeleton, in which the first skeleton thickened in the second electrolytic bath is subjected to an electrolysis in at least one other electrolytic bath, also comprising at least a metal structure having a hardness and ductility different from that of said metal screen and an organic compound improving the growth of metal on the outer surface of the screen in a direction substantially perpendicular to said outer surface, said organic compound being a class 2 brightener containing a double or triple bond other than the $=\overset{|}{C}-\overset{\|}{S}=O$ group and presenting properties of a second class brightener, the said screen thickened in the second electrolytic bath being subjected to electrolysis in at least one other electrolytic bath, said other electrolytic bath also comprising at least said organic compound improving growth of metal on the outer surface of the thickened screen in a direction substantially perpendicular to said outer surface and causing the deposit of metal different from the metal deposited from the second bath.

2. The process of claim 1, in which additional electrolytic baths are used.

3. The process of claim 1, in which metal is deposited from at least one additional electrolytic bath.

4. The process of claim 1, in which in one of the later electrolytic baths, metal is deposited identical to that of the first electrolytic bath, the metal being deposited from said later electrolytic bath having a hardness differing from that of the metal of the screen.

5. The process of claim 1, in which the metal being deposited from the second electrolytic bath is more flexible than the metal deposited from the first electrolytic bath and the last electrolytic bath.

6. The process of claim 1, in which the second electrolytic bath is selectively an iron bath or a bath of a nickel-iron alloy, whilst the first electrolytic bath is a nickel bath, the other or last electrolytic bath being a nickel bath or a bath comprising a nickel-tin alloy.

7. The process of claim 1, in which during at least part of each electrolysis, a liquid flow is maintained through apertures of the screen, the velocities of the flow of liquid through said apertures ranging between 0.1 and 5.5 cm/sec.

8. The process of claim 1, wherein the metal deposited as top layer from the said one other bath is the same as the metal of the product skeleton.

9. The process of claim 1, in which the organic compound is chosen from the group of ethylene cyanohydrin and hydroxyproprionitrile.

10. An electroformed metal screen with apertures comprising a first product metal base and a metal layer deposited thereon from a second electrolytic bath, wherein the edges of said apertures in the product are substantially free from metal deposited from the second electrolytic bath and from metal of a top layer deposited from at least one other electrolytic bath, the metal of the second bath having a hardness and ductility different from those of the base and of the top layer.

11. An electroformed metal screen according to claim 10, wherein the metal screen is built up from a metal base nickel layer, a metal layer of nickel-iron alloy layer and a top layer of nickel-tin alloy.

12. An electroformed metal screen, according to claim 10, wherein the metal product is obtained by subjecting a first product skeleton formed upon a matrix in a first electrolytic bath and subsequently stripped from the matrix, to an electrolysis in a second electrolytic bath comprising at least a metal having a hardness and ductility different from the hardness and ductility of the metal or metal alloy of the product skeleton and an organic compound improving the growth of metal in a direction perpendicular to the outer surface of the skeleton, said organic compound being a class 2 brightener containing a double or triple bond other than the $=\overset{|}{C}-\overset{\|}{S}=O$ group, and the first skeleton thickened in the second electrolytic bath is subjected to an electrolysis in at least one other electrolytic bath, also comprising at least said organic compound improving growth of metal on the outer surface of the thickened skeleton, in a direction substantially perpendicular to said outer surface and a metal or metal alloy different from the metal as deposited from the second bath.

* * * * *